US011278462B2

(12) United States Patent
Schwardt et al.

(10) Patent No.: US 11,278,462 B2
(45) Date of Patent: Mar. 22, 2022

(54) SYSTEMS AND METHODS FOR CONTROLLING MULTIPLE SURGICAL VARIABLES

(71) Applicant: NuVasive Specialized Orthopedics Inc., San Diego, CA (US)

(72) Inventors: Jeffrey Schwardt, Palo Alto, CA (US); Michael Wentz, Zionsville, PA (US); Jorge Lopez Camacho, Oxnard, CA (US); Frank Phillips, Highland Park, IL (US); Dennis Crandall, Mesa, AZ (US); Alexander Vaccaro, Gladwyne, PA (US)

(73) Assignee: NuVasive Specialized Orthopedics, Inc., San Diego, CA (US)

( * ) Notice: Subject to any disclaimer, the term of this patent is extended or adjusted under 35 U.S.C. 154(b) by 365 days.

(21) Appl. No.: 16/058,750

(22) Filed: Aug. 8, 2018

(65) Prior Publication Data

US 2019/0000705 A1 Jan. 3, 2019

Related U.S. Application Data

(63) Continuation of application No. PCT/US2017/017331, filed on Feb. 10, 2017.
(Continued)

(51) Int. Cl.
*A61G 13/00* (2006.01)
*A61G 13/04* (2006.01)
(Continued)

(52) U.S. Cl.
CPC ..... *A61G 13/0054* (2016.11); *A61G 13/04* (2013.01); *A61G 13/08* (2013.01);
(Continued)

(58) Field of Classification Search
CPC .... A61G 13/0054; A61G 13/08; A61G 13/04; A61G 13/12; A61G 15/02; A61H 1/0222;
(Continued)

(56) References Cited

U.S. PATENT DOCUMENTS 1,374,115 A * 4/1921 Roemer ..... A61H 1/0222 606/243
2,693,796 A * 11/1954 Warner ..... A61H 1/0222 601/98
(Continued)

FOREIGN PATENT DOCUMENTS

CN 202505467 11/2015
CN 204744374 11/2015
(Continued)

*Primary Examiner* — Robert G Santos
*Assistant Examiner* — Alison N Labarge
(74) *Attorney, Agent, or Firm* — Hoffman Warnick LLC

(57) ABSTRACT

A surgical patient interface including a patient support platform having a first end and a second end and configured for secure placement with respect to at least one surface of a building structure, wherein the patient support platform is configured to interface with a patient such that at least the torso of the patient extends in a generally vertical direction between the first end and the second end of the patient support platform, and one or more patient supports coupled to the patient support platform and configured to secure the patient to the patient support platform, such that the at least the torso of the patient is held in a substantially static condition, and such that a target portion of the patient's skin is accessible for surgical puncture or incision.

18 Claims, 5 Drawing Sheets

Related U.S. Application Data

(60) Provisional application No. 62/293,755, filed on Feb. 10, 2016.

(51) Int. Cl.

| | |
|---|---|
| ***A61G 13/12*** | (2006.01) |
| ***A61G 13/08*** | (2006.01) |
| ***A61G 15/02*** | (2006.01) |
| ***A61H 1/02*** | (2006.01) |

(52) U.S. Cl.

CPC ..... *A61G 13/12* (2013.01); *A61G 15/02* (2013.01); *A61H 1/0222* (2013.01); *A61H 1/0229* (2013.01); *A61H 1/0292* (2013.01); *A61H 2201/0192* (2013.01); *A61H 2201/1207* (2013.01); *A61H 2201/164* (2013.01); *A61H 2201/1604* (2013.01); *A61H 2201/1609* (2013.01); *A61H 2201/1623* (2013.01); *A61H 2201/1628* (2013.01); *A61H 2201/1635* (2013.01); *A61H 2201/1652* (2013.01); *A61H 2201/1671* (2013.01); *A61H 2203/0412* (2013.01); *A61H 2203/0487* (2013.01)

(58) Field of Classification Search

CPC ..... A61H 1/0292; A61H 1/0229; A61H 2201/1671; A61H 2201/164; A61H 2201/1623; A61H 2201/1609; A61H 2201/0192; A61H 2201/1628; A61H 2201/0412; A61H 2201/1604; A61H 2201/0487; A61H 2201/1652; A61H 2201/1635; A61H 2201/1207

See application file for complete search history.

(56) References Cited

U.S. PATENT DOCUMENTS

| | | | | |
|---|---|---|---|---|
| 2,865,367 | A * | 12/1958 | Sorenson | A61H 1/0222 606/243 |
| 2,950,715 | A * | 8/1960 | Brobeck | A61H 1/02 606/242 |
| 3,655,968 | A | 4/1972 | Moore et al. | |
| 4,372,551 | A * | 2/1983 | Yurdin | A61G 13/009 378/208 |
| 5,983,424 | A | 11/1999 | Naslund | |
| 6,243,897 | B1 * | 6/2001 | Sumiya | A61H 1/003 5/610 |
| 6,308,712 | B1 * | 10/2001 | Shaw | A61F 5/3769 128/845 |
| 6,353,949 | B1 * | 3/2002 | Falbo | A61G 13/04 5/610 |
| 6,428,497 | B1 * | 8/2002 | Crouch | A61F 5/04 128/845 |
| 7,361,128 | B2 * | 4/2008 | Chen | A61H 1/0218 482/144 |
| 2005/0120479 | A1 | 6/2005 | Habashi et al. | |
| 2007/0189461 | A1 * | 8/2007 | Sommer | A61G 15/02 378/178 |
| 2008/0176714 | A1 * | 7/2008 | Boren | A61H 1/0222 482/10 |
| 2008/0269030 | A1 * | 10/2008 | Hoffman | A61H 1/0218 482/142 |
| 2009/0300845 | A1 * | 12/2009 | Paz | A61G 7/053 5/610 |
| 2010/0147314 | A1 | 6/2010 | Lees | |
| 2010/0217271 | A1 | 8/2010 | Pool et al. | |
| 2011/0230883 | A1 | 9/2011 | Zahrly et al. | |
| 2012/0004494 | A1 | 1/2012 | Payne et al. | |
| 2014/0245537 | A1 * | 9/2014 | Allen | A61G 13/04 5/622 |
| 2015/0032109 | A1 | 1/2015 | Pool et al. | |
| 2015/0196332 | A1 | 7/2015 | Pool et al. | |
| 2015/0313745 | A1 | 11/2015 | Cheng | |
| 2017/0252253 | A1 * | 9/2017 | Kim | A61H 1/0292 |

FOREIGN PATENT DOCUMENTS

| | | |
|---|---|---|
| DE | 213290 | 11/2015 |
| GB | 1274470 | 11/2015 |
| WO | WO0234131 | 11/2015 |
| WO | WO2014070681 | 11/2015 |

* cited by examiner

SYSTEMS AND METHODS FOR CONTROLLING MULTIPLE SURGICAL VARIABLES

CROSS REFERENCE TO RELATED APPLICATIONS

The present application is a continuation of PCT/US17/17331 filed on Feb. 10, 2017 which claims the benefit of the priority date U.S. Provisional Application No. 62/293,755, filed on Feb. 10, 2016, the entire contents of both of which are hereby expressly incorporated by reference into this disclosure as if set forth fully herein.

FIELD

The present disclosure relates generally to medical devices and surgical methods, more specifically to a patient support platform. Such devices as well as systems and methods for use therewith are described.

BACKGROUND

Millions of surgical procedures are performed in the U.S. alone every year. Patients undergoing surgery are positioned for preparation for surgery and/or during the surgical procedure. One of the more common ways a patient is positioned on an operating room table is by being freely placed in a supine position (i.e. lying horizontally with face and torso facing up) or a prone position (i.e. lying horizontally with face and torso facing down).

Many current surgical techniques were designed or have evolved to solve problems specific to the period of time in which the surgery occurs. Some of the factors that have been taken into account in the design of surgical techniques include: the maintenance and handling of the weight of a patient's body without significant movement; the maintenance of a sterile field; easy access by the hands of one or more surgeons or surgical assistants while maintaining safe, ergonomic body positioning of the surgeons or surgical assistants; ease of incorporation of imaging systems including radiographic, fluoroscopic, or other imaging systems; maintenance and continuous measurement of controlled blood pressure; maintenance and continuous measurement of other vital parameters, such as temperature, respiratory rate, heart rate and rhythm, EKG, blood oxygen saturation, anesthesia level, state of reflexes, interface with medical equipment, and many other others. Some of the surgical positions used include prone, supine, lateral, lithotomy, and variations of these positions, such as the Trendelenburg position, the reverse Trendelenburg position, the full or high Fowler's position, the semi-Fowler's position, the jackknife or Kraske position, the high and low lithotomy positions, the fracture table position, the knee-chest position, the Lloyd-Davies position, the kidney position, and the Sims' position.

However, a significant problem with current surgical systems and methods is that anatomical and physiological conditions normal to the patient, such as weight distribution when the patient is standing normally, are not present during preparation of surgery or during the surgical procedure. Thus, patients may experience post-operative problems when returning to normal (i.e., non-surgical) anatomical positions and physiology. Therefore, a need continues to exist for systems and methods for performing surgical procedures under physiological and anatomical conditions normally experienced by the patient in the course of the patient's normal daily activities (e.g., standing, sleeping, sitting).

SUMMARY

The needs described above, as well as others, are addressed by embodiments of the systems and methods for controlling multiple surgical variables described in this disclosure (although it is to be understood that not all needs described above will necessarily be addressed by any one embodiment), as the systems and methods of the present disclosure are separable into multiple pieces and can be used independently or in combination.

The present disclosure provides for a surgical patient interface including a patient support platform having a first end and a second end and configured for secure placement with respect to at least one surface of a building structure. The patient support platform is configured to interface with a patient such that at least the torso of the patient extends in a generally vertical direction between the first end and the second end of the patient support platform. One or more patient supports couple to the patient support platform and are configured to secure the patient to the patient support platform, such that the at least the torso of the patient is held in a substantially static condition, and such that a target portion of the patient's skin is accessible for surgical puncture or incision.

The present disclosure further provides for a method for performing surgery. The method includes placing a surgical patient in a patient support platform having a first end and a second end and configured for secure placement with respect to at least one surface of a building structure. The patient support platform is configured to interface with the patient such that at least the torso of the patient extends in a generally vertical direction between the first end and the second end of the patient support platform. The patient support platform includes one or more patient supports coupled thereto and configured to secure the patient to the patient support platform, such that the at least the torso of the patient is held in a substantially static condition, and such that a target portion of the patient's skin is accessible for surgical puncture or incision. The method includes using one or more of the one or more patient supports to secure the surgical patient to the patient support platform, and performing surgery on the patient.

DETAILED DESCRIPTION

Embodiments of the present invention provide systems and methods for performing surgery on a patient such that patient anatomical and/or physiological conditions preparing for and during surgery are more closely reproduced to reflect anatomical and/or physiological conditions during normal patient activities (e.g., standing, sitting, sleeping) than current standard surgical techniques. Advantageously, the systems and methods of the present disclosure are capable of being used in conjunction with many current surgical positions. For example, the systems and methods of the present disclosure can be used with a patient placed in a prone position, which is used in a large percent of thoracic, lumbar, and sacral spine surgeries.

Figure 1:
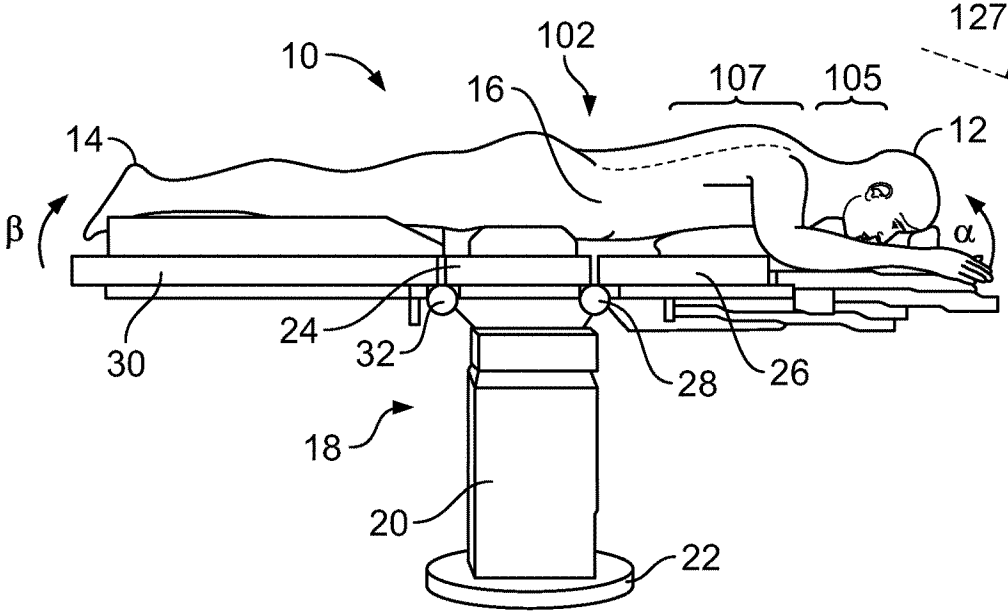
FIG. 1. A perspective view of a patient in a supine position on an embodiment of a surgical table.

A surgical patient 10 is shown in FIG. 1 in a prone position on a surgical table 18, with the patient's head 12 and feet 14 extending generally horizontally in opposite directions from the patient's torso 16. In the prone position, the patient's dorsal side is facing up and the patient's ventral side is facing down. The surgical table 18 may include a base 20 having a floor interface 22 and a patient support platform 24 extending in a horizontal, or generally horizontal, direction with respect to the base 20. The base 20 may be vertical, or generally vertical. A first adjustable platform portion 26 may extend horizontally, or generally horizontally, from the platform 24 and may be tilted by angle $\alpha$ around a first pivot 28. Similarly, a second adjustable platform portion 30 may extend horizontally, or generally horizontally, from the platform and oppositely from the first adjustment platform portion 24, and may be tilted by angle $\beta$ around a second pivot 32.

Figure 2:
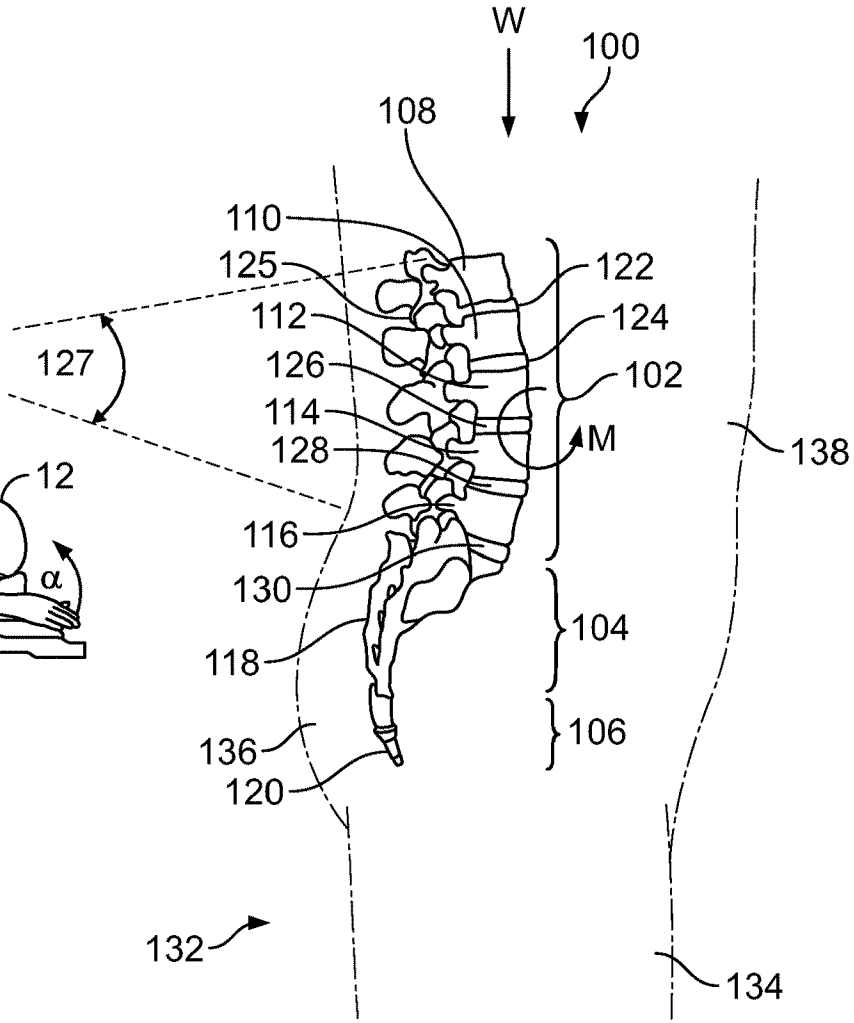
FIG. 2. A cross-sectional view of a portion of a vertebral column.

FIG. 2 illustrates a sagittal plane view of a portion of a vertebral column 100. As depicted, the vertebral column 100 includes a lumbar region 102, a sacral region 104, and a coccygeal region 106. The vertebral column 100 also includes a cervical region 105 and a thoracic region 107 (shown in FIG. 1). The lumbar region 102 of the vertebral column 100 includes a first lumbar vertebra 108, a second lumbar vertebra 110, a third lumbar vertebra 112, a fourth lumbar vertebra 114, and a fifth lumbar vertebra 116. The sacral region 104 includes a sacrum 118. Further, the coccygeal region 106 includes a coccyx 120.

As shown in FIG. 2, a first intervertebral lumbar disc 122 is disposed between the first lumbar vertebra 108 and the second lumbar vertebra 110. A second intervertebral lumbar disc 124 is disposed between the second lumbar vertebra 110 and the third lumbar vertebra 112. A third intervertebral lumbar disc 126 is disposed between the third lumbar vertebra 112 and the fourth lumbar vertebra 114. A fourth intervertebral lumbar disc 128 is disposed between the fourth lumbar vertebra 114 and the fifth lumbar vertebra 116. And, a fifth intervertebral lumbar disc 130 is disposed between the fifth lumbar vertebra 116 and the sacrum 118. Zygapophysial joints 125, also known as facet joints or z-joints, are located on the posterior of the vertebral column 100 on each side where two adjacent vertebrae (108, 110, 112, 114, 116) meet.

If one of the intervertebral lumbar discs (i.e., 122, 124, 126, 128, 130) is diseased, degenerated, or damaged or if one of the zygapophysial joints 125 is diseased, degenerated, or damaged, that disc or joint can be at least partially treated using an implanted device that provides rigid fixation, dynamic fixation, or adjustable fixation, including noninvasively-adjustable fixation. For example, a disc replacement device can be inserted into one of the intervertebral lumbar disc (e.g., 122, 124, 126, 128, 130) or one or more of the zygapophysial joints (e.g., 125).

In humans who are standing in a neutral position, a normal lumbar spine may be described as having a lumbar lordosis angle (LLA) 127 in the sagittal plane (i.e., the anatomical plane which divides the body into right and left halves) between about 20° and 40°. An LLA less than 20° is frequently considered lumbar hypolordosis and an LLA greater than 40° is frequently considered lumbar hyperlordosis. Similarly, the normal thoracic spine may be described as having a thoracic kyphosis of between about 20° and 50°, or between about 20° and 45°, or between about 25° and 45°. The lumbar region 102 is one of the key support elements for the upper portion of the body, weight (W) of which may, in many persons, constitute 50% or more of the persons' total body weight. The lordosis of the lumbar spine critically contributes to the lumbar region's 102 ability to support large amounts of weight. It is also important (along with the thoracic kyphosis) to a person's balance. When describing a patient's full or complete body herein (or simply "patient's body"), the term should be inclusive of all parts of the body, including the head and feet. Other modifiers may be used to denote specific portions of the patient's body (e.g., "upper body portion").

Attempts may be made to position the body during prone lumbar spine surgery (such as illustrated in FIG. 1) in such a way to mimic normal lumbar lordosis. However, simply matching the patient's normal lumbar lordosis angle (LLAn) or a desired lumbar lordosis angle (LLAd) frequently does not create an anatomically or physiologically accurate condition. This is because many of the parameters of a normal standing, walking, sitting, running, or even reclining person are not recreated. First, the upper body portion weight W is not being applied to the lumbar region 102 during a prone lumbar spine surgery. Nor is a moment M, related to the upper body portion weight W (shown in FIG. 2), experience by the lumbar region 102. Furthermore, the body muscles 132, which can generate forces to help support the lumbar region 102, are not in the same condition (e.g., flexed, toned, or contracted). Body muscles 132 may include, but are not limited to, leg muscles 134 (e.g., quadriceps, hamstring), gluteal muscles 136 (e.g., gluteus maximus, gluteus minimus), abdominal muscles 138, and other muscles and/or muscle groups. In addition, the body comprises a large percentage of water (one might call it a pressure vessel). Some types of anesthesia may significantly change vascular tone, for example, blood vessel dilation or construction. Such changes in vascular tone may alter the surrounding forces on the lumbar region 102 and the vascularization and mechanical condition of the lumbar region 102. Intraabdominal pressure in an upright person is at least partially dependent on the hydrostatic pressure of water in the body. Therefore, in a prone (or otherwise horizontally-oriented) patient, the abdominal pressure is likely changed, thus further changing the condition on the lumbar region 102. Moreover, during surgery body temperature commonly drops as much as one degree Celsius, or more, which may further affect any of the conditions mentioned.

Numerous types of surgery are performed with a primary purpose of improving the patient's mobility by changing the shape or condition of a portion of the patient's skeletal system. These surgeries may also reduce pain that the patient feels when in certain positions or when performing certain movements. Many of the higher stress positions or movements (and therefore, the positions and movements commonly responsible for increased pain) occur when a patient is in an erect (e.g., standing, walking, running) or a sitting position. In both erect and sitting positions, the lumbar region 102 of the vertebral column 100 fully or partially supports the upper body portion weight W. Oftentimes, the effect of a surgical procedure on the lumbar region 102 is not fully known until a patient has recovered, at least partially and sometimes fully, from surgery, and is able to engage in common movements and/or positions (e.g., run, walk, stand, sit), and thereby judge whether balance has improved, pain has diminished, stiffness has decreased, mobility has increased, or other factors have improved (e.g., in a noticeable fashion). Because the mechanical/physical conditions experienced by patients during surgery are so unlike the key high-stress positions and/or actions the patient typically experiences, the surgical technique tends to be based on a certain amount of conjecture or guess-work.

Examples of surgeries in the lumbar region 102 area include, but are not limited to: Anterior Lumbar lnterbody Fusion (commonly known as "ALIF"), Foraminotomy, Forminectomy, Kyphoplasty, Laminectomy, Laminoplasty, Laminotomy, Posterior Lumbar lnterbody Fusion (commonly known as "PLIF"), Scoliosis correction, including modifying a coronal plane deformity, Spinal Decompression, Spinal Fusion, Spinal Osteotomy, and Transforamenal Lumbar lnterbody Fusion (commonly known as "TLIF"). Along with these procedures, a discectomy or microdiscectomy may be performed. Lasers may be used in such surgical procedures. The procedures may be performed with normal incisions, or with smaller incisions (e.g., minimally invasive surgery). Some procedures may be performed endoscopically. Thoroscopic surgery may include, for example, thoroscopic release. In a large number of procedures, spinal instrumentation may be implanted to fixate or "instrument" a portion of the spine. This may include holding one or more vertebrae static with respect to one or more other vertebrae, for example, to aid fusion. Spinal instrumentation may include metal rods, screws, hooks, wires, and/or other materials, including polymers like PEEK.

Certain types of spinal instrumentation allow a finite, controlled amount of movement between bones (e.g., vertebrae); these types of spinal instrumentation are often called dynamic stabilization instrumentation. Other types of spinal instrumentation include adjustable spinal instrumentation. These include instrumentation that may be adjusted (e.g., lengthened or distracted) via a minimally invasive puncture or small incision. For example, through such a minimally invasive puncture or incision, a screw may be loosened, then a spinal rod may be lengthened, and then the screw may be retightened to again hold the spinal rod. Some such instrumentation has been named "growing rods." One such implant is the VEPTR® or VEPTR II™ (Vertical Expandable Prosthetic Titanium Rib), manufactured by DePuySynthes, West Chester, Pa., USA. Recently, non-invasively adjustable spinal instrumentation has been developed which allows non-invasive post-surgical adjustment (e.g., lengthening, shortening). That is, no additional incision is required. For example, the MAGEC® system, manufactured by Ellipse Technologies, Inc., Irvine, Calif., USA, is a magnetically adjustable implant that may be lengthened or shortened after implantation by the use of an externally-applied magnetic field (e.g., a rotating magnetic field).

In addition to the changes in normal anatomy and physiology described above, a prone surgical position may place blood vessels in vulnerable positions, including, but not limited to, the vena cava, the aorta, the carotid artery, and/or the saphenous vein. The prone position may also make the patient's body susceptible to hyperextension of joints, and may increase the chance of damage to nerves including, but not limited to, the radial, brachial, median, and/or ulnar nerves. The prone position may additionally place undesirable stress(es) on the lungs and/or other portions of the respiratory system.

Figure 4:
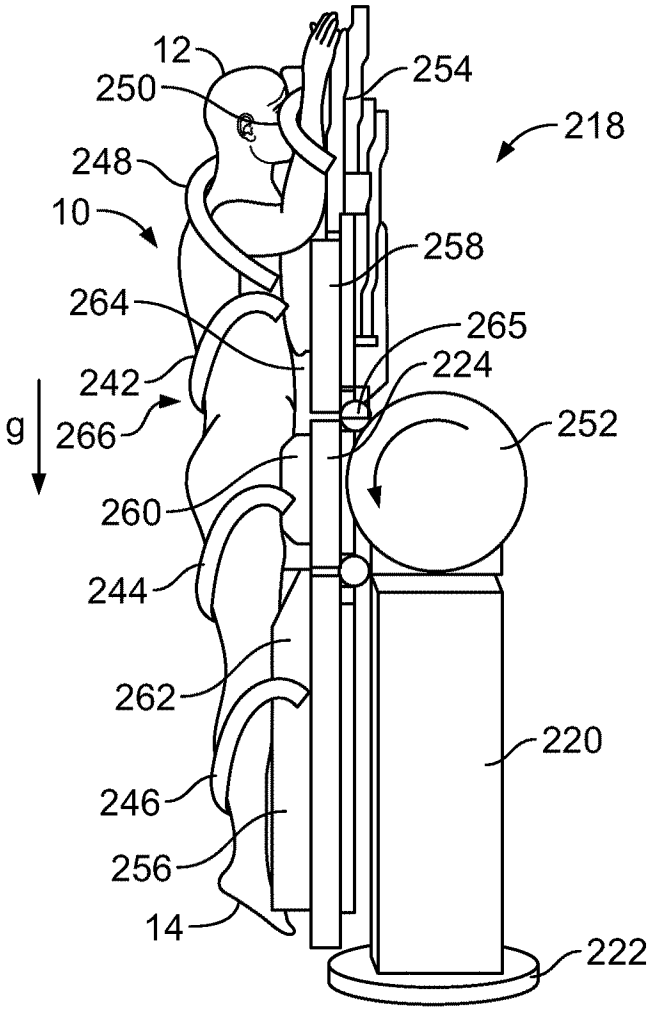
FIG. 4. A perspective view of the vertical surgical table of FIG. 3 in a second position.
Figure 3:
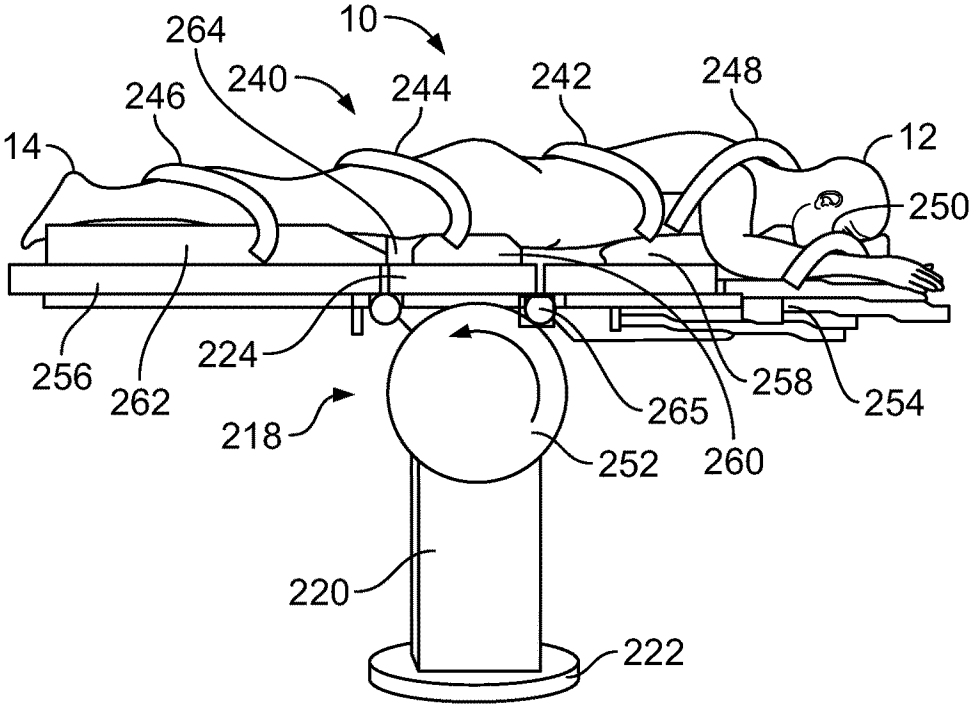
FIG. 3. A perspective view of an embodiment of a vertical surgical table in a first position.

FIGS. 3 and 4 illustrate a surgical table 218 configured to hold a patient 10. Though the word "table" is used, it should not be defined as a strictly horizontal structure. In fact, a feature of the surgical table 218 is that it includes a platform 224 that is configured to extend in either a generally horizontal direction (such as is shown in FIG. 3) or a generally vertical direction between its first end 254 and its second end 256 (such as is shown in FIG. 4). The platform 224 is shown in FIG. 3 coupled to a base 220 having an interface 222 (e.g., a floor interface). In FIGS. 3 and 4, the interface 222 is shown coupled to, and supported by, a floor, but it may alternatively be coupled, and secured, to a wall, a ceiling, or another solid structure/surface. In some embodiments, the platform 224 may be permanently attached to a wall, ceiling, floor, or other structure, in a vertical position (similar to that shown in FIG. 4) either via the base 220 or without the base 220 (i.e., directly attached). The base 220 may be configured to rest on the floor, and the base 220 may be configured to balance on the floor. The embodiment illustrated in FIGS. 3 and 4, however, shows the platform 224 adjustably coupled to the base 220 by a pivotable joint 252. The platform 224 may be rotationally adjusted between the horizontal position of FIG. 3 and the vertical position of FIG. 4, or any position in between. The rotating (manually or motorized) may be used to reversibly change the patient 10 position from approximately horizontal (prone, supine, lateral decubitus) to an approximately vertical (upright, equivalent to standing) during a surgical procedure, thereby creating access for a surgeon to initially place implants while the patient 10 is in prone position, then make final surgical adjustments with the patient 10 in vertical position. A motor (not shown) may be carried on the surgical table 218, and a control 265 may be used to adjust the platform 224 (e.g., rotate the platform 224 about the pivotable joint 252). FIG. 3 shows the patient in a prone, set-up position. That is to say that, the patient may be prepared (e.g., anesthetized, draped, swabbed, cleaned, etc.) in a prone position, prior to rotating the platform 224 to another desired position. The vertical position of the patient in FIG. 4 may be useful when performing vertical surgery, which can include any type of surgery that is benefitted by the patient's vertical orientation in relation to the earth's gravitational field. Such types of surgery may include the lumbar spine surgeries already mentioned, among several other surgeries that may benefit from the significantly different loads and conditions on the patient's body or portions of the patient's body. The manipulation of the sagittal plane may greatly benefit such surgeries. Examples of possibly advantageous manipulation include increasing or decreasing kyphosis, and/or increasing or decreasing lordosis. Examples include, but are not limited to, thoracic or thoracolumbar scoliosis surgery, limb lengthening (femur, tibia, fibula), trauma surgery (femur, tibia, fibula), ankle surgery, hip surgery, knee surgery, and surgery to correct rotational or angular defects of a bone.

In order to maintain the patient in a stable, substantially static condition during vertical surgery, one or more patient supports 240 may be coupled to the platform 224, and may include straps 242, 244, 246, 248, 250, and/or bolsters 258, 260, 262. In some embodiments, the straps 242, 244, 246, 248, 250 may include one or more of a hole, a pocket, a hook and loop fastener feature, a tie-off, an adhesive feature, a clamp, and a groove. In some embodiments, the bolsters 258, 260, 262 may include one or more of a pillow, a rod, a tube, a mound, a bag, a pad, an inflated structure, a filled structure, and a buttress. The bolsters 258, 260, 262 may be configured to at least partially support at least one of a head, a neck, a shoulder, an arm, and elbow, a hand, a chest, a waist, a hip portion, a leg, a knee, an ankle, a foot, or any combination thereof. The patient 10 may be secured to the platform 224 using the patient supports 240 such that the patient's weight is well supported (e.g., evenly, securely, firmly, immovably) in the vertical position of FIG. 4. In some embodiments, the patient supports may secure the patient 10 to the platform 224 without good distribution of the patient's weight. In an embodiment, the patient supports 240 are configured to support the patient in a zero-gravity environment, such as in space and underwater. The patient supports 240 may be configured to transfer much of the counter-force to the body weight to frictional forces against the platform 224 (which may include one or more pads 264) and the bolsters 258, 260, 262. Counterforce to the body weight may even be transferred by frictional forces against the straps 242, 244, 246, 248, 250. The orientation of the straps 242, 244, 246, 248, 250 may be configured to prevent over-compression of one or more points on the patient's body (e.g., key point, pressure points, key nerves). Strap 242 may be used for securing the patient 10 at one or more locations at or on the waist. Strap 244 may be used for securing the patient 10 at one or more locations at or on the upper leg or thigh. Strap 246 may be used for securing the patient 10 at one or more locations at or on the lower leg or knee, or calf. Strap 248 may be used for securing the patient 10 at one or more locations at or on the shoulder or axilla (underarm). Strap 250 may be used for securing the patient 10 at one or more locations at or on the arm. Each of the straps 242, 244, 246, 248, 250 and bolsters 258, 260, 262 may be singular, or paired (e.g., one on each side), or multiple.

The platform 224, in its entirety or a portion thereof, may be adjustable in relation to the base 220. The first end 254 or the second end 256 may be adjustable, such as angularly, rotationally, linearly, or in multiple axis, in relation to the base 220. The platform 224 may be locked in relation to the base 220.

The orientation of each of the patient supports 240 is such that an open, accessible area 266 in the skin may be left available for surgical preparation. Depending on the configuration of the patient supports 240 chosen, that area 266 may be at least 60 $cm^2$, at least 120 $cm^2$, or at least 200 $cm^2$. The area 266 may be rectangular, square, circular, or any other shape that facilitates a surgical procedure, regardless of invasiveness (e.g., whether the surgery is minimally invasive or maximally invasive). In some embodiments, the vertical orientation of the patient may be adjusted to be partially vertical (i.e. from 90° to 60° from the direction of gravity), mostly vertical (i.e. from 20° to 60° from the direction of gravity), or substantially vertical (i.e., 0° to 20° from the direction of gravity). In some embodiments, the vertical orientation may be changed by around 180 degrees (e.g., from about positive vertical (i.e., feet down/head up) to about negative vertical (i.e., feet up/head down)). Adjustment away from vertical may be used to change (e.g., slightly change) the effective body weight of the patient, or the effective upper body portion weight W, which exerts force in the direction of gravity.

Figure 6:
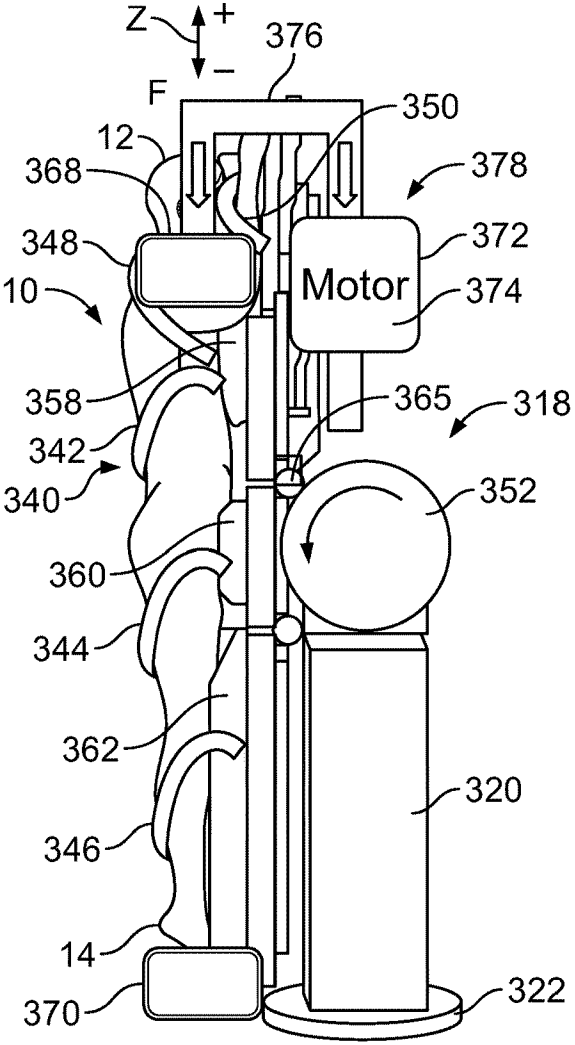
FIG. 6. A perspective view of the vertical surgical table of FIG. 5 in a second position.
Figure 5:
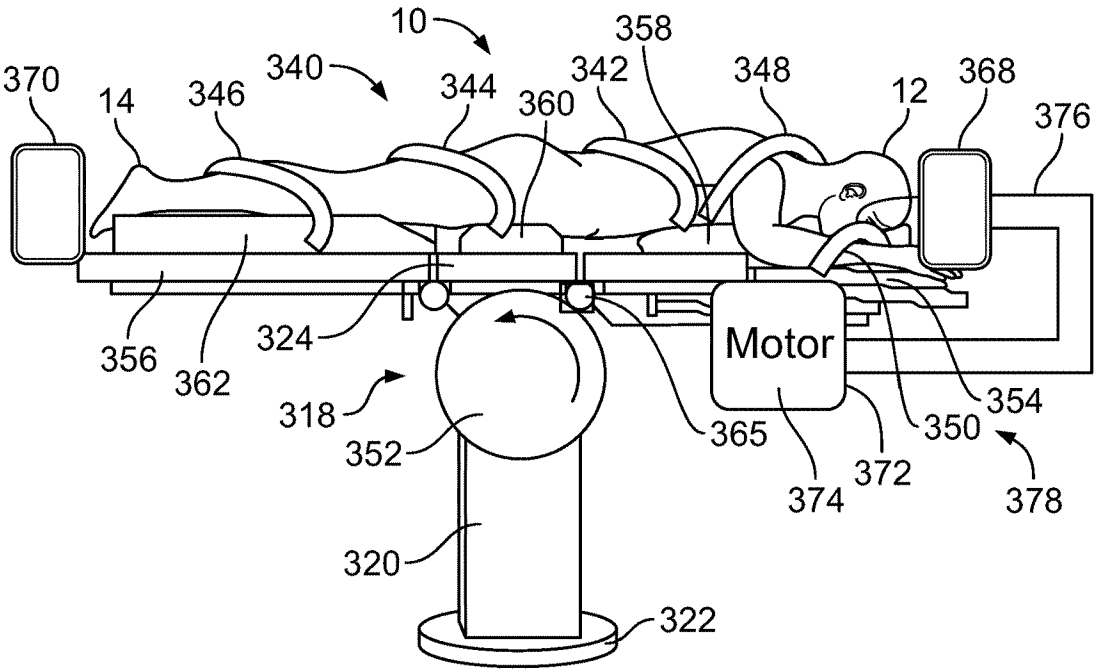
FIG. 5. A perspective view of another embodiment of a vertical surgical table in a first position.

FIGS. 5 and 6 illustrate a patient 10 on a surgical table 318 having an adjustable platform 324 and a base 320. The platform 324 has a first end 354 and a second end 356, and is adjustable in relation to a pivotable joint 352, by use of a control 365 and a motor (not shown). The base 320 may include an interface 322. Patient supports 340 may include one or more pads 360, straps 342, 344, 346, 348, 350 and bolsters 358, 360, 362, similar to those described above (i.e., pad 260, straps 242, 244, 246, 248, 250, and bolsters 258, 260, 262 of FIGS. 3 and 4). FIG. 6 illustrates a vertical surgical position of the patient 10.

The surgical table 318 includes a load adjustment module 378. The load adjustment module 378 may be disposed at the first end 354 such that it is positioned proximate to the patient's upper body portion, such as the patient's shoulders or heads, when the patient 10 is positioned on table 318. First stop 368 and second stop 370, each of which are coupled to the platform 324, are adjustable to apply a linear compressive force F on the patient 10. In other embodiments, each of the stops 368, 370 or both of the stops 368, 370 may be adjustable in relation to the platform 324. However, in FIGS. 5 and 6, second stop 370 is shown to be fixably coupled to the platform 324, while first stop 368 is adjustably coupled to the platform 324 along an axis, which may be defined as the direction of the sagittal plane. A motor 372, adjustable via a control unit 374, is configured to adjust first stop 368 along axis Z, for example, by moving an arm 376 in a positive or negative direction along axis Z. When the first stop 368 is moved in the negative direction, the first stop 368 and the second stop 370 place/generate a longitudinally-applied compressive force on the patient 10. In embodiments having an adjustably coupled second stop 370, when the second stop 370 is moved in the positive direction, the first stop 368 and the second stop 370 place/generate a longitudinally-applied compressive force on the patient 10. The first stop 368 may have a fixed position.

FIG. 6 shows the stop 368 engaging one or more shoulder, and stop 370 engaging one or more foot and applying (or increasing) the compressive force. The stop 368 may be configured to engage the shoulder as a pair of first stops 368, each pair of stops 368 configured to apply force to each shoulder. Alternatively, a single stop 368 may only apply force to one shoulder or both shoulders. The stops 368, 370 may be configured to engage other parts of the patient's body, including, but not limited to the knee, buttock, head and neck. In some embodiments, the stops 368, 370 may be replaced by harnesses or hooks, and be configured to apply traction, instead of compression. The harnesses or hooks may be configured to engage other body portions, including, but not limited to the axilla, upper foot, knee, hip, thigh, groin, and even head or neck. In other embodiments, a pair of combination stop/harness fixtures may allow for both adjustable traction and adjustable compression. The patient's body parts may be engaged either in an uncovered or unclothed state, or in a covered or clothed state. By allowing adjustment of the forces on the patient, a desired surgical condition may be controllably applied/created. For example, in certain surgeries, it may be desired to control the compression or traction force, but limit or negate the effect of gravity—in such cases, the surgery may be performed on a patient in the horizontal position of FIG. 5 (thereby effectively eliminating standard upright gravity) while using the load adjustment module 378 to generate/simulate compression or traction forces.

Figure 8:
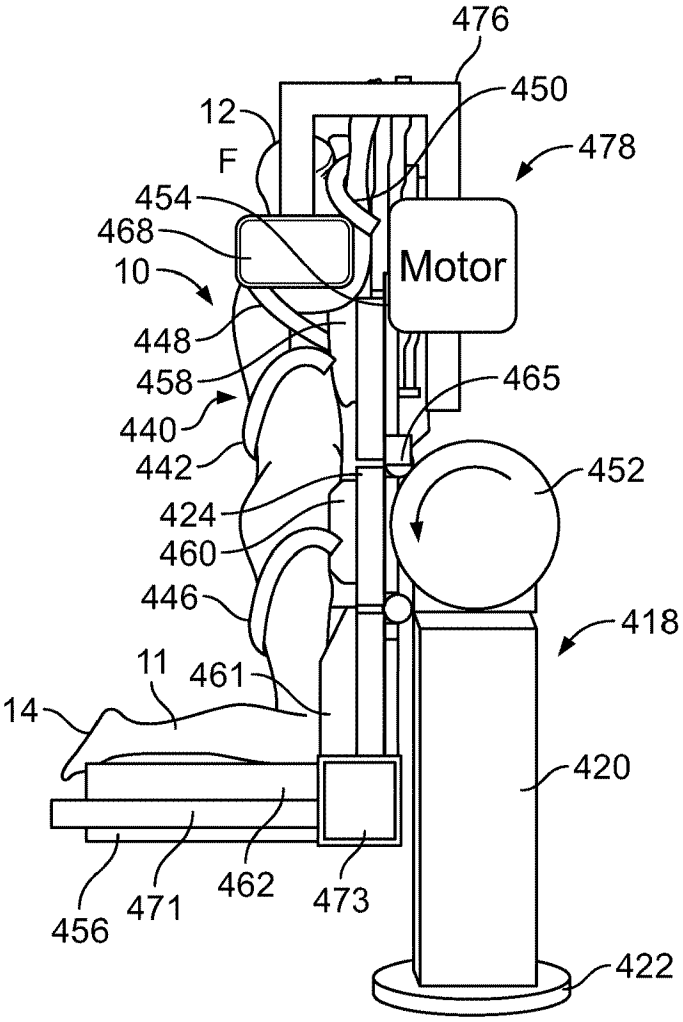
FIG. 8. A perspective view of the vertical surgical table of FIG. 7 in a second position.
Figure 7:
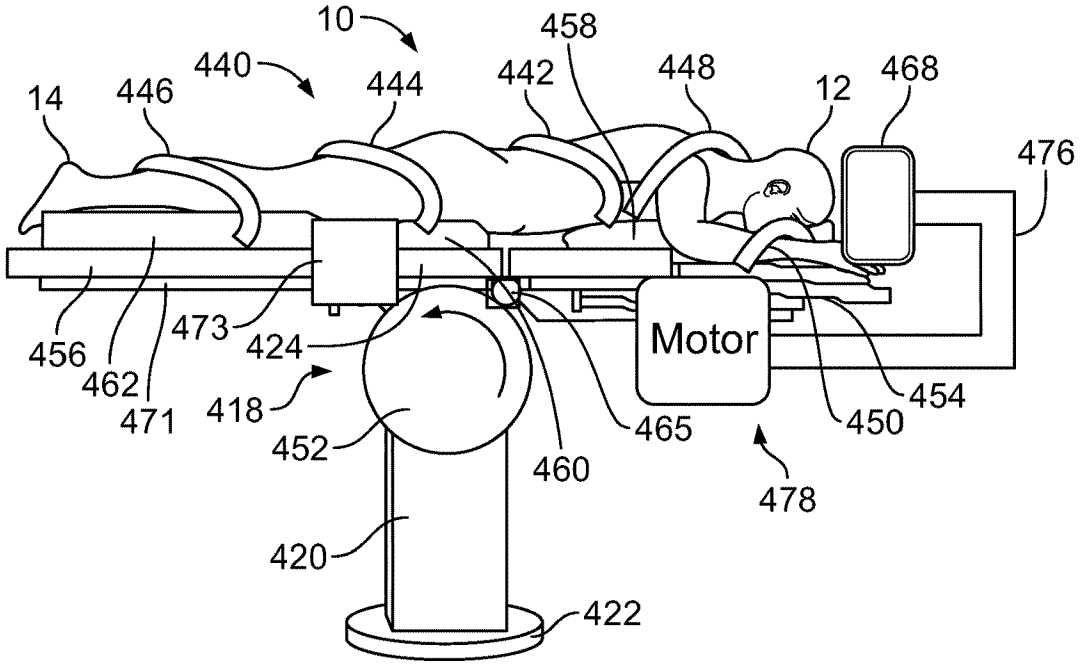
FIG. 7. A perspective view of a further embodiment of a vertical surgical table in a first position.

FIGS. 7 and 8 illustrate a patient 10 on a surgical table 418 having an adjustable platform 424 and a base 420. The platform 424 has a first end 454 and a second end 456, and is adjustable in relation to a pivotable joint 452, by use of a control 465 and a motor (not shown). The base 420 may include an interface 422. The surgical table 418 has patient supports 440 that may include one or more pads 460, straps 442, 444, 446, 448, 450 and bolsters 458, 460, 462, similar to those described above (i.e., pad 260, straps 242, 244, 246, 248, 250 and bolsters 258, 260, 262 of FIGS. 3 and 4). FIG. 8 illustrates the vertical surgical position of a knee-to-shoulder portion of the patient 10. The first platform portion 471 may be adjusted (FIG. 8) so that the lower leg 11 of the patient 10 bends (e.g., extends in a substantially horizontal direction), while the knee-to-shoulder portion of the patient 10 extends in a substantially vertical direction. The table 418 includes a load adjustment module 478. The table 418 includes a first stop 468 adjustably coupled to the load adjustment module 478 via arm 476, and first platform portion 471 is pivotably coupled to the platform 324 via a pivot joint 473. The first stop 468 is adjustable relative to the first platform portion 471 to apply a linear compressive force F on the patient, for example, between the knees and the shoulder. Again, the first stop 468 and the first platform portion 471 may be used to engage other portions of the body and to apply forces between them. The first platform 471 may serve as a platform for feet or knees, and the first stop 468 may function as a bumper for the shoulders, such that a fraction (0-100%) of body weight can be applied through the skeleton. The table 418 may hold the patient 10 in a kneeling position while maintaining standing upright position of the torso.

As described in relation to the embodiment of FIGS. 5 and 6, harnesses or hooks (or the like) may be used to apply traction instead of compression.

Figure 10:
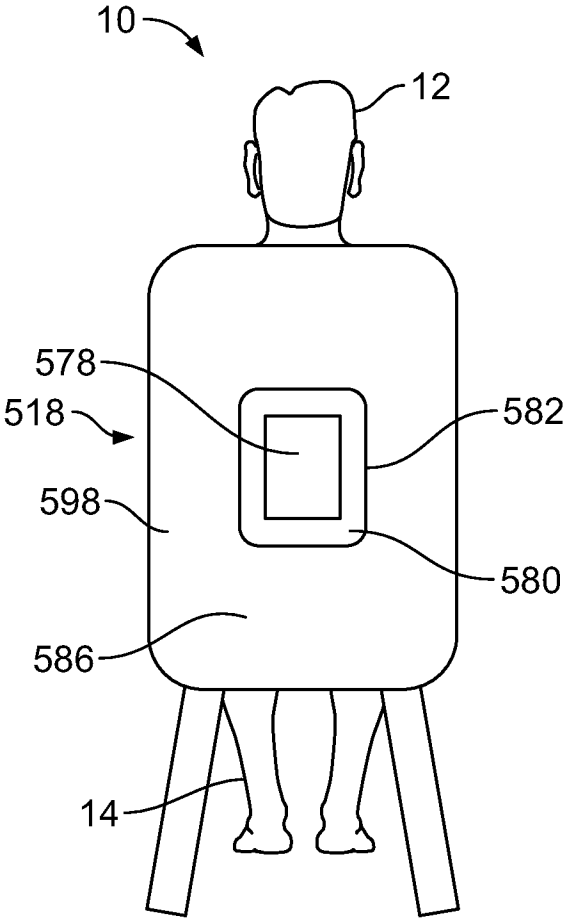
FIG. 10. A rear elevation view of the chair-based surgical table of FIG. 9.
Figure 9:
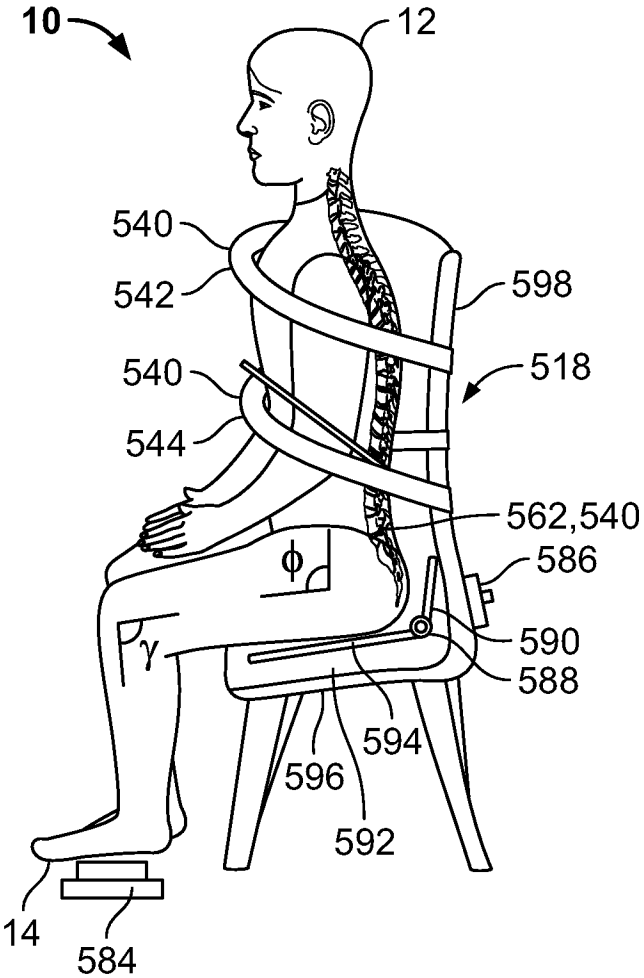
FIG. 9. A perspective view of an embodiment of a chair-based surgical table.

FIGS. 9 and 10 illustrate a chair-based or seat-based surgical table 518. The surgical table 518 includes a backrest portion 598 and a seat portion 596. The backrest portion 598 and the seat portion 596 may each be contoured to best fit a patient's body. The seat portion 596 may be angularly adjustable in relation to the backrest portion 598 (e.g., angularly and/or linearly). In some embodiments, an internal plate 594 within a seat pad 592 is angularly adjustable with respect to a frame 590 attached to the backrest portion 598 about a pivot joint 588. The adjustment may be controlled by a control 586 which may operate a manual adjustment mechanism or a motorized adjustment mechanism. One or more patient supports 540 may include straps 542, 544 and bolsters 562. The straps 542, 544 and bolsters 562 may maintain spinal curvature in an anesthetized patient in a sitting position or a standing position, such that the patient's spinal curvature and sagittal balance are equivalent to the standing or sitting neutral position of the patient before surgery. One or more adjustable height footrests 584 may be used (with or without the internal plate 594 adjustment) to control femur-to-hip angle $\phi$ and/or femur-to-tibia angle $\gamma$. An open window 582 through the backrest portion 598 may allow for surgical access to the patient. The open window 582 may be positioned and expose access to the lumbar region 102, the sacral region 104, the coccygeal region 106, the cervical region 105, and the thoracic region 107, or combinations thereof (shown in FIG. 2). The window 582 may enable surgical, percutaneous, or transcutaneous manipulation of spinal anatomy of the supine patient 10. Load adjustment modules, similar to the load adjustment modules 378, 478 of the embodiments of FIGS. 5-6 and FIGS. 7-8, may also be incorporated into the chair-based surgical table 518 of FIGS. 9 and 10. One or more portions of the chair-based surgical table 518 may comprise materials that are partially or completely radiolucent to enable intra-operative radiographic imaging.

Advantageously, the support structure(s) described herein is capable of replicating anatomical and physiological conditions that the patient experiences during the patient's normal activities, such as sleeping, standing, and sitting. In this way, the presently disclosed support structure(s) allow a surgeon to operate on a patient with the benefit of observing, during the operating procedure, the effects of the surgical technique target as well as enabling the surgeon to select surgical technique based on the anatomical and physiological conditions that the patient normally experiences. It is believed that this benefit of the present support structure (s) and methods of use will result in improved surgical outcomes for patients.

In relation to any of the embodiments disclosed herein, all of the patient's weight may be borne by the patient (e.g., the patient's feet). Alternatively, in relation to any of the embodiments disclosed herein, a portion may be borne by the patient (e.g., the patient's feet) while a portion is borne by a support structure (e.g., stop 368, 370, 468 or first platform portion 471). The embodiments described herein may be used in surgical procedures which use general anesthesia, conscious sedation, local anesthesia, or other varieties of anesthesia. One or more drugs may be given to modify muscle tone of the patient 10. Stimulation, for example electrical stimulation, may be used to modify muscle tone. Stimulation may be done percutaneously, transcutaneously, or via an open or minimally invasive incision. A sterile field may be maintained during open surgery in an upright patient, such as with tented sterile drapes may be used in any of the embodiments to prevent drifting or falling particulate from entering surgical wound. Filtered air handling equipment may be used to move clean air over patient and prevent particulate from entering surgical wound.

In an embodiment, a method of placing and manipulating a musculoskeletal implant in a patient is provided. The method includes positioning the patient such that the bones of the head, spine, pelvis, and lower extremity are oriented in an upright standing position. The method may include performing a surgical intervention, either through an open skin incision or with minimally invasive percutaneous methods. The surgical intervention may be performed with the use of a robotic or robot-assisted surgical system. The surgical intervention may be performed with the use of an image-guided navigation system. The surgical intervention is performed with the use of minimally invasive access cannulas, retractors, and surgical instruments. The surgical intervention may be performed with the use of a fiber optic visualization system. The surgical intervention may include non-invasively adjusting the implant with a transcutaneous device that activates the implant to manipulate internal anatomy. The surgical intervention may be performed to implant a device on or near the cervical spine, thoracic spine, lumbar spine, pelvis, one or more hip or knee joints, or any combination thereof. The implant may be: a lumbar pedicle fixation device that can modify sagittal spine curvature, a lumbar pedicle fixation device that can modify coronal spine curvature. The device may be adjusted to modify varus or valgus alignment of bones connected by a joint, and the device can be adjusted to address flexion-extension misalignment of bones connected by a joint.

In another embodiment, a method for performing a surgical procedure is provided. The method includes placing a patient in a patient support platform having a first end and a second end and configured for secure placement with respect to at least one surface of a building structure, wherein the patient support platform is configured to interface with a patient such that at least the torso of the patient extends in a generally vertical direction between the first end and the second end of the patient support platform, the patient support platform including one or more patient supports coupled thereto and configured to maintain the position of the patient with respect to the patient support platform, such that the at least the torso of the patient remains in a substantially static condition, and such that a target portion of the patient is accessible. The method includes placing an external adjustment device in proximity to the target portion of the patient, and performing an adjustment procedure on the patient. The external adjustment device may be a magnetic device and configured to adjust a magnetic implant within the patient. The anatomy of the patient 10 may be manipulated by non-invasive external remote control of the magnetic implant.

In some embodiments, a method for performing surgery is provided. The method includes placing a surgical patient in a patient support platform having a first end and a second end and configured for secure placement with respect to at least one surface of a building structure, wherein the patient support platform is configured to interface with a patient such that at least the torso of the patient extends in a generally vertical direction between the first end and the second end of the patient support platform, the patient support platform including one or more patient supports coupled thereto and configured to secure the patient to the patient support platform, such that the at least the torso of the patient is held in a substantially static condition, and such that a target portion of the patient's skin is accessible for surgical puncture or incision. The method includes using one or more of the one or more patient supports to secure the surgical patient to the patient support platform, and performing surgery on the patient. The surgery may be performed through a window in the patient support platform.

In addition to performing surgery with a patient positioned using the various systems and methods disclosed herein, other procedures may be performed in a conscious (i.e. awake) and/or non-surgical patient. For example, patients who have been implanted with non-invasively adjustable spinal instrumentation, such as the MAGEC® system, may be placed in, on, adjacent, or against any of the embodiments described herein to have their non-invasive adjustment procedures performed. For example, a window in any embodiments disclosed herein, may be configured to allow the placement of an external adjustment device (e.g., magnetic external adjustment device) adjacent the skin of the patient to perform non-invasive adjustment (lengthening, shortening, etc.). Additionally, patients who have been implanted with implants which are adjustable via a minimally invasive procedure (e.g., growing rods, VEPTR®) may be placed in, on, adjacent, or against any of the embodiments described herein to have their minimally-invasive adjustment procedures performed.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or sub-combinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

Similarly, this method of disclosure is not to be interpreted as reflecting an intention that any claim requires more features than are expressly recited in that claim. Rather, as the following claims reflect, inventive aspects lie in a combination of fewer than all features of any single foregoing disclosed embodiment. Thus, the claims following the Detailed Description are hereby expressly incorporated into this Detailed Description, with each claim standing on its own as a separate embodiment.

What is claimed is:

1. A surgical patient interface comprising:

a base;

a platform coupled to the base and including a first end and a second end, wherein the platform is configured to transition between a first position and a second position about a pivotable axis stationary relative to the base;

a first abutment and a second abutment each adjustably coupled to the platform;

wherein, in the first position, the platform extends between the first end and the second end in a substantially horizontal direction relative to the base, and the first abutment and the second abutment are separated by a first distance along the substantially horizontal direction, and wherein, in the second position, the platform extends between the first end and the second end in a substantially vertical direction such that a torso of a patient extends substantially in a vertical direction, and the first abutment and the second abutment are separated by a second, different distance along the vertical direction;

and a load control module configured to adjust one or both of the first abutment and the second abutment to change a load on the patient when the platform is in the second position.

2. The surgical patient interface of claim 1, wherein the platform is configured to be coupled to a wall, ceiling, or floor.

3. The surgical patient interface of claim 1, wherein the platform has contours to interface with one or more portions of the patient's body.

4. The surgical patient interface of claim 1, wherein the platform if configured such that the patient's head is placed towards the first end and the patient's knees, buttocks, or feet are placed towards the second end.

5. The surgical patient interface of claim 1, wherein the platform comprises a generally L-shaped structure or a seat.

6. The surgical patient interface of claim 1, wherein the platform comprises a generally flat platform structure.

7. The surgical patient interface of claim 1, wherein the platform includes a window configured for surgical access to the patient.

8. The surgical patient interface of claim 1, wherein the load control module is configured to engage one or more covered or uncovered shoulder, axilla, foot, or underside of a foot, or upper side of a foot, knee, buttock of the patient.

9. The surgical patient interface of claim 1, wherein the load control module comprises a motor.

10. The surgical patient interface of claim 9, wherein the motor is configured to change the distance between the first end of the platform and the second end of the platform.

11. The surgical patient interface of claim 10, wherein the motor is configured to change the distance between the first abutment and second abutment when the platform is in the second position.

12. The surgical patient interface of claim 10, wherein the platform comprises a first harness and a second harness, and wherein at least one of the first harness and second harness is adjustable in relation to the platform, and wherein the motor is configured to change the distance between the first harness and the second harness.

13. The surgical patient interface of claim 1, wherein the load control module is configured to adjust a traction force, a compression force, or a combination thereof on at least a portion of the patient.

14. The surgical patient interface of claim 1, wherein the load control module is configured to apply a desired traction force, a desired compression force, or a combination thereof on at least a portion of the patient.

15. The surgical patient interface of claim 1, wherein the load control module is configured to apply a desired traction force on at least a first portion of the patient, and to apply a desired compression force on at least a second portion of the patient.

16. The surgical patient interface of claim 1, further comprising one or more patient supports coupled to the platform and configured to secure a patient to the platform, such that the at least the torso of the patient is held in a substantially static condition, and such that a target portion of the patient's skin is accessible for surgical puncture or incision.

17. The surgical patient interface of claim 16, wherein the target portion of the patient's skin comprises skin on the posterior of the patent adjacent the lumbar vertebrae.

18. The surgical patient interface of claim 16, wherein the one or more patient supports are configured to releaseably secure a portion of the patient's body.

* * * * *